United States Patent [19]

Stephenson

[11] 4,410,228

[45] Oct. 18, 1983

[54] SPRING-LOADED TERMINAL ASSEMBLY

[75] Inventor: Brian D. Stephenson, Camp Hill, Pa.

[73] Assignee: AMP Incorporated, Harrisburg, Pa.

[21] Appl. No.: 286,749

[22] Filed: Jul. 27, 1981

[51] Int. Cl.[3] ..... H01R 11/22

[52] U.S. Cl. ..... 339/95 D; 339/254 M; 339/255 R

[58] Field of Search ..... 339/95 D, 97 R, 97 P, 339/98, 99 R, 254 R, 254 M, 255 R

[56] References Cited

U.S. PATENT DOCUMENTS

| | | | |
|---|---|---|---|
| 374,843 | 12/1887 | Lange | 339/254 M |
| 1,660,807 | 2/1928 | Norgren | 339/253 S |
| 2,761,115 | 8/1956 | Visconti | 339/255 B |
| 2,911,615 | 11/1959 | Popejoy et al. | 339/254 M |
| 3,665,372 | 5/1972 | Goode et al. | 339/254 R |
| 3,806,860 | 4/1974 | Flammini | 339/254 R |

*Primary Examiner*—John McQuade
*Assistant Examiner*—Paula Austin
*Attorney, Agent, or Firm*—Russell J. Egan

[57] ABSTRACT

An improved spring-loaded terminal assembly is disclosed of the type in which an insulating housing has a conductor-receiving aperture extending into a cavity defined by the housing and alignable with a corresponding aperture in a terminal mounted in the cavity. Resilient means, which maintains the apertures normally out of axial alignment, must be overcome to align the apertures to permit insertion of a conductor therein. The resilient means then returns the apertures to an unaligned orientation, thereby pinching the conductor between the apertures. Specifically, the improvement consists of integrating the resilient means into the terminal.

5 Claims, 6 Drawing Figures

SPRING-LOADED TERMINAL ASSEMBLY

The present invention relates to an improved spring-loaded terminal assembly for providing a temporary path of conductivity from a printed circuit board to ribbon cable.

There is disclosed in U.S. Pat. No. 374,843, a spring-loaded coupling device for forming temporary connections between electric conductors, comprising conducting tubes, movable pins, respectively extending into said tubes, openings in said pins corresponding to the openings in the tubes, and means normally tending to place the openings in the pins out of alignment with the openings in the tubes.

In this known device, the means for normally tending to place the openings out of alignment is a coil spring acting between each pin and a housing defining the conductor passages. The device thus requires three primary components as follows: a housing defining conducting tubes, pins, and coil springs.

The state of the art at this time, incorporating the general concept of the foregoing patented device, is embodied in stereo component terminal assemblies, an example of which is distributed by Radio Shack as Cat. No. 274-625. Like the above coupling device, these terminal assemblies comprise three components as follows: a housing having a conductor receiving aperture extending into a cavity in the housing; a terminal mounted in the cavity having a conductor-receiving aperture alignable with the housing aperture; and a coil spring acting to maintain the apertures out of alignment.

The present invention is intended to provide a spring-loaded terminal assembly of the above kind which is substantially simplified in that the terminal and spring elements are combined into a single component.

A spring-loaded terminal assembly is, according to the present invention, characterized in that the resilient means is an integral extension of the terminal. The simplified configuration thus achieved decreases the number of parts required, thereby reducing fabrication costs.

Although U.S. Pat. No. 1,660,807 discloses a binding post having alignable slots normally held out of alignment by resilient means, the resilient means, as in the above patent and stereo component terminals, again is a separate coil spring element and, therefore, lacks the simplicity of the present invention.

For a better understanding of the invention, reference will now be made by way of example to the accompanying drawings, in which.

Figure 5:
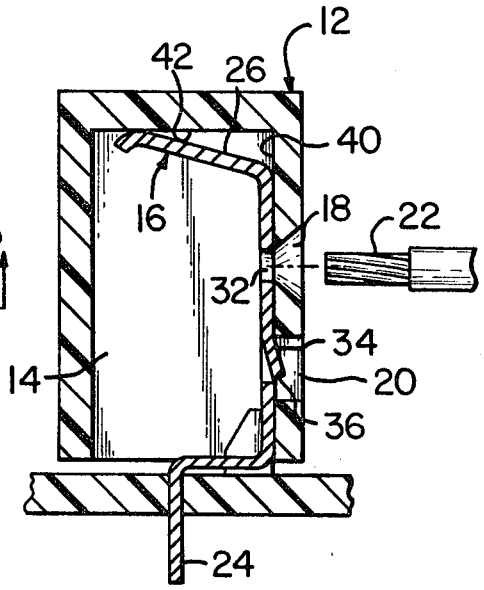
Figure 6:
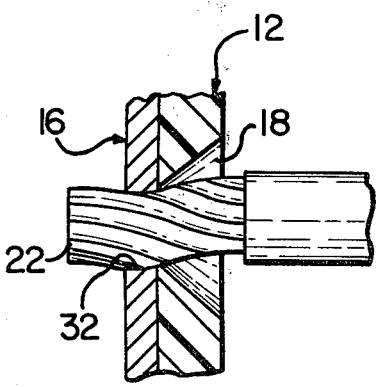

FIG. 5 is a vertical section through the terminal assembly showing a housing aperture and corresponding terminal aperture in an aligned orientation to permit insertion of a conductor; and FIG. 6 is a vertical detail section through the terminal assembly showing a conductor pinched between a housing aperture and corresponding terminal aperture after the resilient terminal free end portion has returned the apertures to an unaligned orientation.

Figure 1:
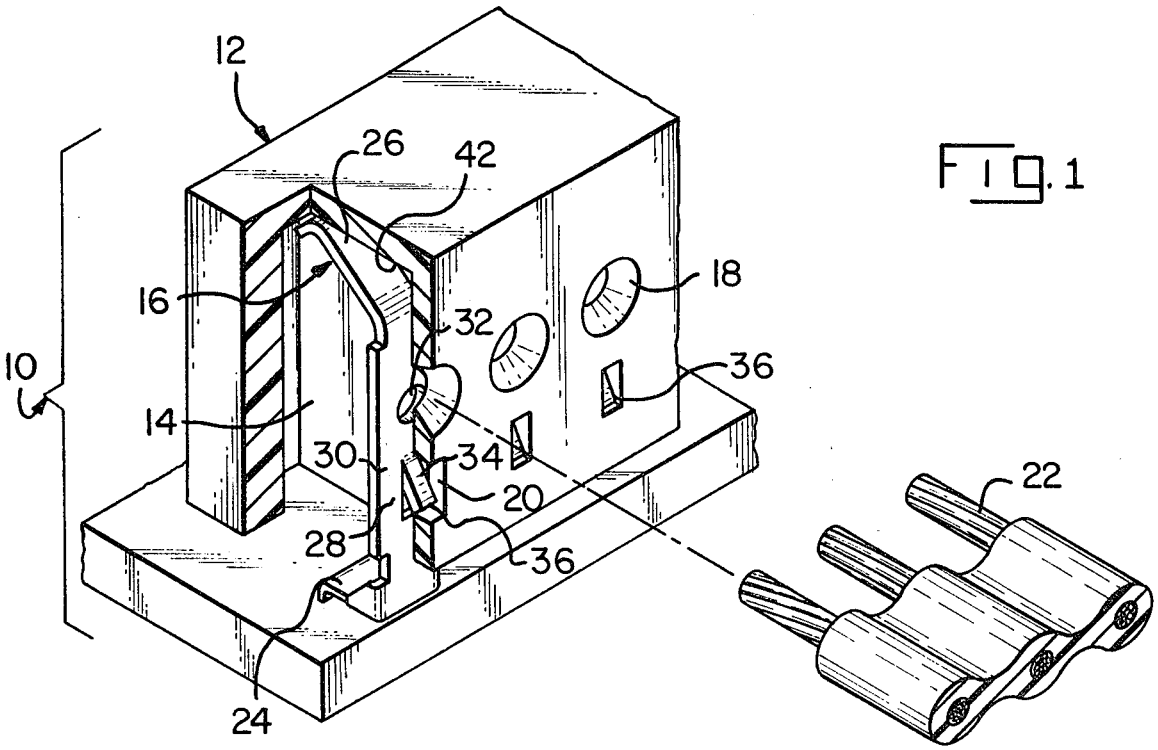
FIG. 1 is a perspective view of a spring-loaded terminal assembly in accordance with the present invention, the terminal assembly for illustration being shown mounted on a printed circuit board.

A spring-loaded terminal assembly 10 in accordance with the present invention, FIG. 1, comprises a housing 12 of rigid insulative material. The housing 12 defines at least one profiled cavity 14 each having a terminal 16 mounted therein. The housing 12 also has a like number of conductor-receiving apertures 18 each extending through the housing 12 into a corresponding cavity 14 and a like number of lance-engaging recesses 20 each opening into a corresponding cavity 14. Each housing aperture 18 is tapered toward the cavity 14 to facilitate insertion of a conductor 22 therein.

Figure 2:
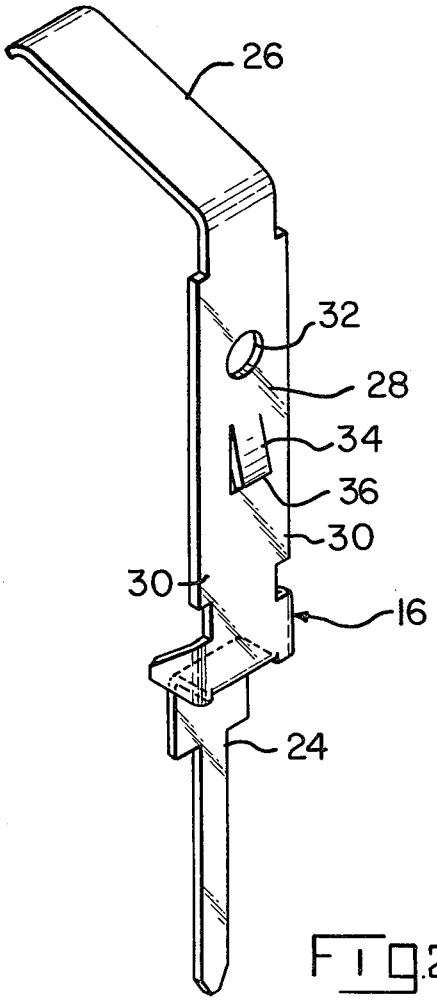
FIG. 2 is a perspective view of a terminal in accordance with the present invention.

Each stamped and formed plate member terminal 16, FIG. 2, includes a mounting tail 24 extending from the profiled cavity 14 and insertable, for example, in a printed circuit board as shown. A free end portion 26 is bent out of the plane defined by the terminal plate member to form a resilient action arm. Intermediate the mounting tail 24 and free end portion 26 is a body portion 28 having a pair of transverse flanges 30. A conductor-receiving aperture 32 extends through the body portion 28 and is axially alignable with the corresponding housing aperture 18. The body portion 28 also has a lance 34 extending from the plane defined by the terminal plate member. The lance 34 defines a shoulder 36 directed toward the mounting tail 24.

Figure 3:
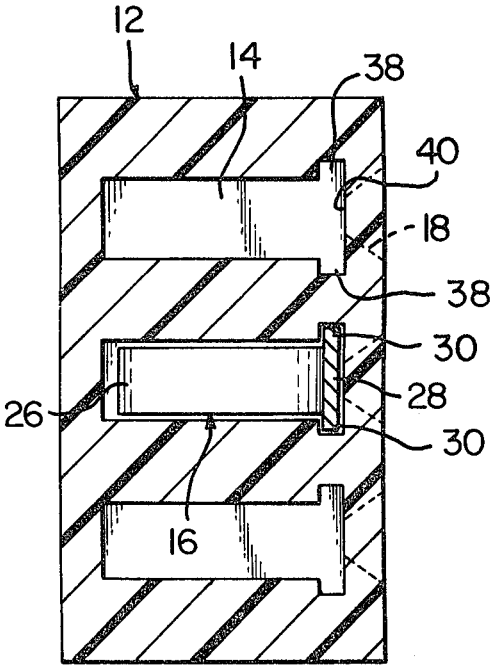
FIG. 3 is a horizontal section through the terminal assembly housing showing the T-shaped profiled cavities and a terminal positioned therein.

Each profiled cavity 14, FIG. 3, has transverse extension 38 at one end 40 that give the cavity 14 a T-shaped profile. The T-shape is oriented so that the corresponding housing aperture 18 extends into the cavity 14 at the one end 40 where the transverse extensions 38 are located.

Figure 4:
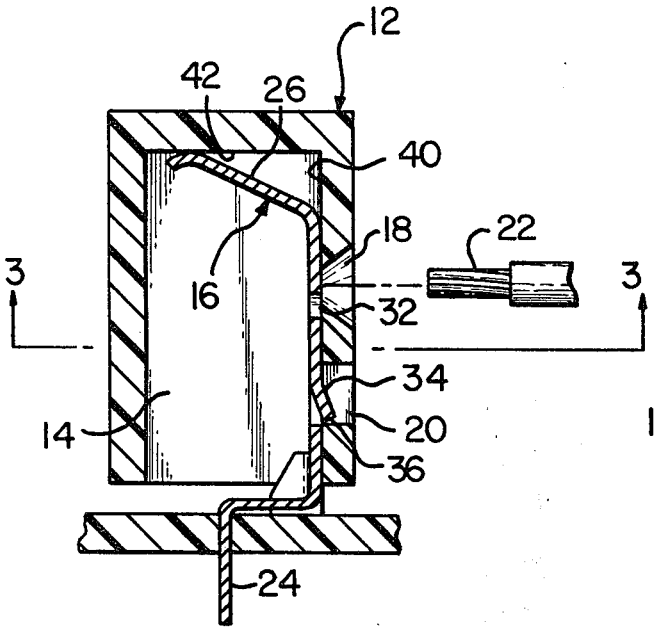
FIG. 4 is a vertical section through the terminal assembly showing a housing aperture and corresponding terminal aperture in a normally unaligned orientation.

A terminal 16 is assembled into the housing 12 by inserting the flanged body portion 28 into the slot formed by the cavity extensions 38 until the lance 34 engages with the housing recess 20, FIG. 4. Each housing aperture 18 and corresponding terminal aperture 32 are thus held in a normally unaligned orientation by each terminal free end portion 26 resiliently bearing on a cavity bottom 42. The lance 34 engaged with the recess 20 prevents separation of the housing 12 from a terminal 16.

To permit insertion of a conductor 22, the apertures 18 and 32 are axially aligned by pushing the housing 12 toward the mounting tail 24. This motion is resisted by the resilient terminal free end portion 26, so that after the conductor 22 is inserted and the housing 12 released, the resilient free end portion 26 returns the aperture 18 and 32 to an unaligned orientation, FIG. 6, thereby pinching the conductor 22 between the housing aperture 18 and corresponding terminal aperture 32.

The present invention may be subject to many modifications and changes without departing from the spirit or essential characteristics thereof. The present embodiment is therefore to be considered in all respects as illustrative and not restrictive of the scope of the invention.

I claim:

1. A spring-loaded terminal assembly comprising:

a housing of rigid insulative material defining at least one profiled cavity therein, a like number of conductor-receiving apertures each extending through said housing into a respective one of said cavities; and a terminal in each said cavity, each said terminal being an elongated stamped and formed metal member having a body portion with a pair of integral transverse flanges and a conductor-receiving aperture extending through said body portion axially alignable with said housing aperture;

a mounting tail extending from one end of said body portion beyond said profiled cavity; and an integral resilient extension extending from the other end of said body portion and bent out of the plane defined by said body portion, said extension maintaining said housing and terminal apertures in a normally unaligned orientation so that the resilient force of said resilient extension must be overcome to axially align said apertures and allow a conductor to be inserted therein, said resilient extension returning said apertures into said axially unaligned orientation thereby pinching said conductor between said housing aperture and said terminal aperture.

2. A terminal assembly according to claim 1, wherein each said cavity has a transverse extension at one end thereof to form a T-shaped profile oriented so that each said housing aperture extends through said housing and into each said profile cavity at said one end, said transverse extensions forming terminal retaining means to slidably receive said flanges of each said terminal, with said resilient extension of each said terminal extending toward and resiliently bearing on the bottom of each said profiled cavity.

3. A terminal assembly according to claim 2 wherein:

said body portion of each said terminal has a lance extending from the plane defined by said body portion, each said lance defining a shoulder directed toward said mounting tail; and said housing has a lance-engaging recess opening therethrough into each said cavity and positioned to receive said lance therein whereby separation of said terminal and said housing is prevented.

4. A terminal assembly according to claim 2 wherein said housing is a four-sided prismoid.

5. A terminal assembly according to claim 2 wherein each said housing aperture is a circular passage tapering toward said one side of a respective one of said cavities to facilitate insertion of said conductor into said housing aperture.

* * * * *